United States Patent [19]

Perez

[11] Patent Number: 4,840,597

[45] Date of Patent: Jun. 20, 1989

[54] DOLL WITH MEANS FOR PRODUCING SOAP BUBBLES AND HAVING AN ANTI-SPILL CONTAINER

[75] Inventor: Jose L. J. Perez, Biar Alicante, Spain

[73] Assignee: Jesmar S.A., Biar, Spain

[21] Appl. No.: 63,423

[22] Filed: Jun. 17, 1987

[30] Foreign Application Priority Data

Jun. 17, 1986 [ES] Spain ..... 294,821

[51] Int. Cl.[4] ..... A63H 33/28; A63H 13/00; A47G 19/22

[52] U.S. Cl. ..... 446/16; 446/354; 220/90.4

[58] Field of Search ..... 446/15, 16, 17, 18, 446/19, 20, 21, 384, 354; 220/90.4; D7/9, 10

[56] References Cited

U.S. PATENT DOCUMENTS

| | | | |
|---|---|---|---|
| Des. 37,096 | 8/1904 | Haviland | D7/9 |
| Des. 252,372 | 7/1979 | Macaulay | D7/9 |
| 660,485 | 10/1900 | Bradshaw | 446/18 X |
| 1,733,478 | 10/1929 | Warham | 40/408 X |
| 3,228,136 | 1/1966 | Rouse | 446/16 |
| 3,234,688 | 2/1966 | Neumann et al. | 446/185 |
| 3,412,892 | 11/1968 | Waksman et al. | 220/90.4 |
| 3,781,164 | 12/1973 | McCaffery | 220/74 |
| 3,874,115 | 4/1975 | London et al. | 47/41.11 |
| 4,299,049 | 11/1981 | Pimentel et al. | 446/15 |
| 4,423,565 | 1/1984 | Bart | 446/16 |
| 4,556,392 | 12/1985 | Chang | 446/16 |

FOREIGN PATENT DOCUMENTS

| | | | |
|---|---|---|---|
| 890155 | 9/1953 | Fed. Rep. of Germany | 446/16 |
| 2802956 | 8/1978 | Fed. Rep. of Germany | 446/197 |
| 2380045 | 10/1978 | France | 446/303 |

*Primary Examiner*—Mickey Yu
*Assistant Examiner*—Charles H. Harris
*Attorney, Agent, or Firm*—Staas & Halsey

[57] ABSTRACT

A doll is provided capable of blowing bubbles. The doll has a receptacle for holding bubble making liquid attached to the doll's trunk. A bubble making tool having a ring-shaped end is attached to a moveable arm of the doll. The arm is able to pivot about the trunk so that the tool may be dipped in the liquid and raised up to a mouth opening formed in the doll. An air impeller is located in the doll's head and forces air out of the doll's mouth when a circuit is closed by the motion of the arm in bringing the tool close to the mouth opening. Bubbles are produced when the air flows through the ring-shaped end of the tool coated with a liquid film.

9 Claims, 3 Drawing Sheets

DOLL WITH MEANS FOR PRODUCING SOAP BUBBLES AND HAVING AN ANTI-SPILL CONTAINER

BACKGROUND OF THE INVENTION

1. Field of the Invention

The present invention relates to a doll having elements for producing soap bubbles, and more particularly to a doll which can be used by young children safely and with minimal risk of spilling the bubble-making liquid while keeping user interest high.

2. Description of the Related Art

Many types of bubble blowing toys and devices have been developed for children. Children have a fascination with the creation of bubbles out of liquid. Examples of bubble blowing toys directed to children are disclosed in U.S. Pat. Nos. 1,733,478 (bubble blowing elephant) 2,842,894 (bubble blowing toy figure); 3,228,136 (electrical bubble blowing toy); 3,388,498 (bubble making toy figure); and 4,556,392 (bubbling self-propelled toy). For the most part, these devices are one dimensional, in that the only function they serve is that of a bubble blowing apparatus. Further, many of the devices are too complicated for younger children, thereby requiring adult supervision or assistance. Due to these restrictions, it is often difficult for bubble blowing devices to hold the interest of younger users.

SUMMARY OF THE INVENTION

Accordingly, an objective of this invention is to provide a doll capable of blowing bubbles.

Another object of this invention is to provide a bubble blowing device which has an independent use as a doll.

A further object of this invention is to provide a doll having elements for producing bubbles which is easily manufactured at a low cost.

Additional objects and advantages of the invention will be set forth in part of the description which follows, and, in part, will be obvious from the description or may be learned by practice of the invention. The objects and advantages of the invention may be realized and obtained by means of the instrumentalities and combinations particularly pointed out in the appended claims.

To achieve the foregoing objects and in accordance with the purpose of the present invention, the doll includes: a toy body of human configuration having a trunk portion bearing a receptacle for containing a mixture of water and soap necessary for the production of the bubbles, as well as a head portion within which there is housed an electronically actuated air impeller device which is functionally connected to a mouth opening present in said head portion; upper extremities or arms, at least one of which is pivotally mounted on said trunk portion and, operatively connected to a switch element for controlling the electric circuit for the actuation of said air impeller device; a tool for forming the bubbles, having a handle portion for attachment to the movable arm or arms and a ring-shaped portion for forming the actual bubbles. Furthermore, the mouth opening of the aforesaid head portion and the trunk portion on which the receptacle for the soapy solution is arranged are disposed along a circumferential arc which has its center at the point of articulation between the arm and trunk and a radius corresponding to the effective length of the arm and tool for the production of bubbles. In this way, by manually moving said pivoted arm it is possible to introduce the bubble-producing tool into the corresponding receptacle and then position the tool, in front of the mouth opening of said head portion. Air is then impelled from the mouth toward the tool, whereby a bubble is made.

DETAILED DESCRIPTION OF THE PREFERRED EMBODIMENTS

Figure 2:
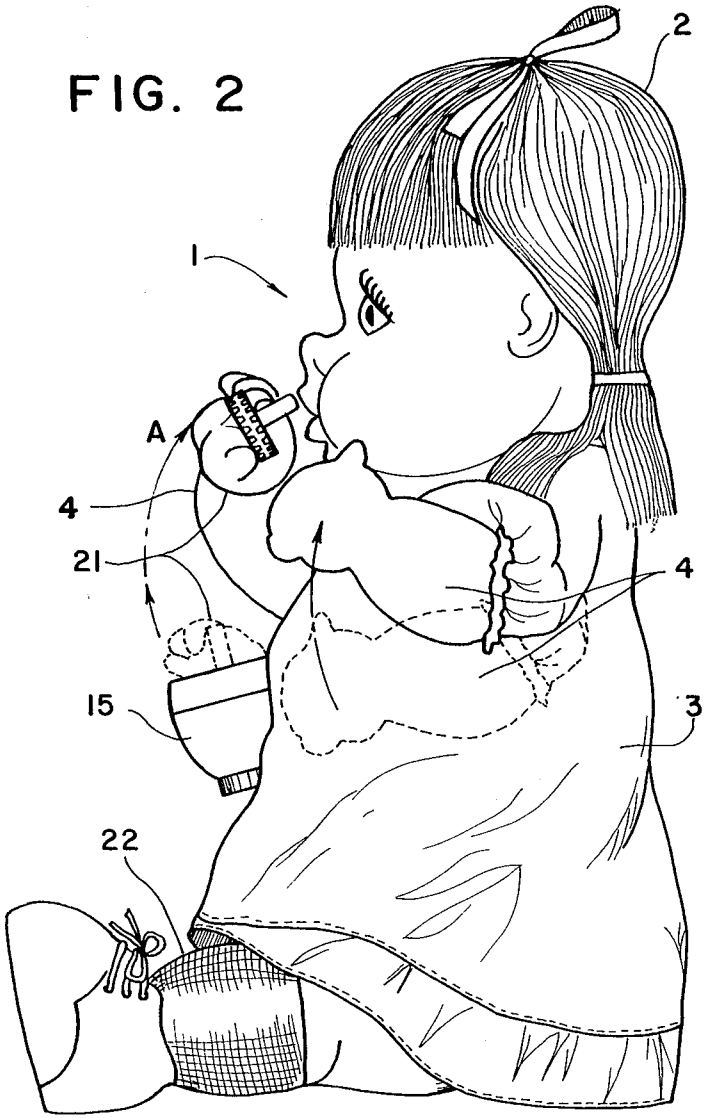
FIG. 2 is a side view showing the pivotal motion of the arms of the doll.
Figure 1:
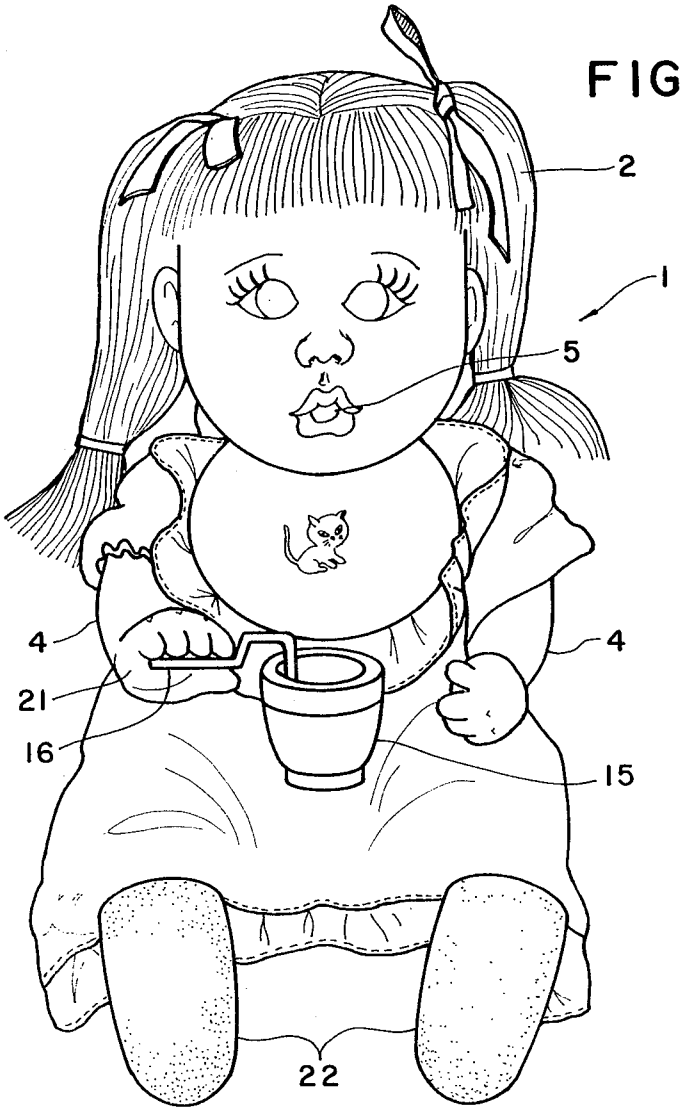
FIG. 1 is a front view illustrating the doll of the present invention.

The structure of the present invention is illustrated in FIGS. 1 and 2. A doll 1 is formed of a body having a head portion 2, a trunk portion 3, a lower limbs portion 22 (legs and feet), and a pair of arms 4, at least one of which is articulated, e.g., swinging on the aforementioned trunk portion 3, as is illustrated in FIG. 2. Attached to the trunk portion 3 is a receptacle 15 for holding bubble making liquid. Attached to the pivoting arm 4 is a hand 21 which holds a tool 16 which can be dipped in the bubble making liquid contained in the receptacle 15 and then moved directly opposite an opening 5, which imitates a mouth, in the head portion 2 so that bubbles can be formed utilizing air forced through the opening 5, as discussed in detail below. At least the arm 4 holding the tool 16 is pivotally mounted. The second arm may also be pivotally mounted on a single axis through the trunk portion 3 so that the arms 4 ascend and descend together.

Figure 3:
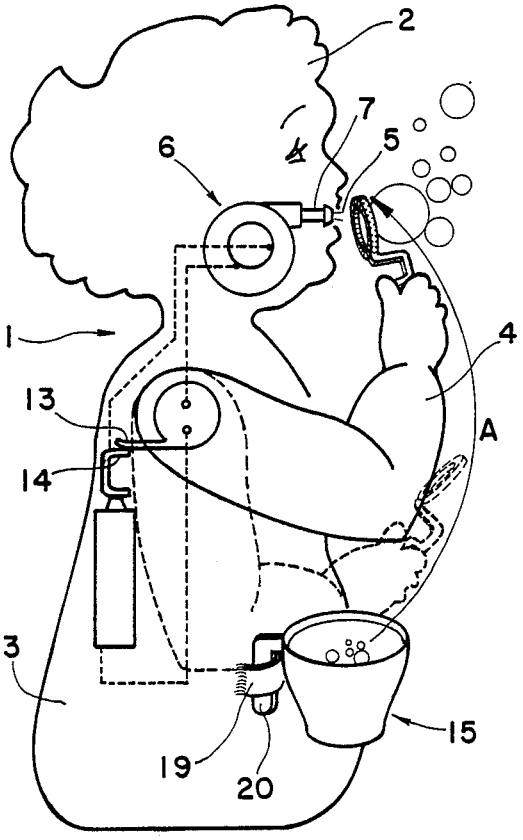
FIG. 3 is a side view, partially in section, of the doll of the present invention, in which the arrow A shows the movement effected by the pivoted arm thereof.
Figure 6:
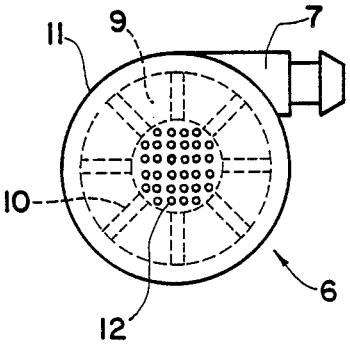
FIG. 6 is a side, cross-sectional view of the air impeller device.
Figure 7:
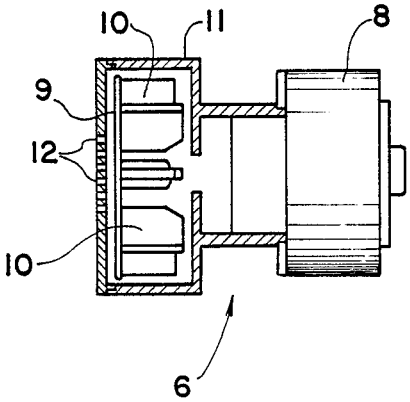
FIG. 7 is a top, partial cross-sectional view of the air impeller device.

The bubble making elements can be seen more easily in FIGS. 3, 6 and 7. An air impeller device 6, which will be described in greater detail below, has an outlet nozzle 7 which is coupled to said mouth opening 5 in such a manner that the stream of air generated thereby will emerge through the mouth opening 5 via the nozzle 7.

The air impeller device 6 consists of an electric motor 8 which is powered by a battery 23, the live terminal of which is connected to a rotor 9 having a plurality of transverse vanes 10 which is fitted in the interior of a cylindrical body 11 in which said outlet nozzle 7 is tangentially conformed. In addition, in said cylindrical body 11 there are formed a plurality of holes 12 which serve as suction intakes of the device 6.

Referring still to FIG. 3, the arm 4 which is articulated on the trunk portion 3 has, in a region within said trunk portion 3 a stem or lug 13 which is operatively connected to a switch 14, for instance a blade switch 14, arranged in a feed circuit of the motor 8 of the air impeller device 6. The arrangement of the stem or lug 13 is such that in a position of rest of the doll 1, the switch 14 is in its open position, while in an active position of the doll, that is to say with the arm raised upward by the manual action of the user or mechanical action, the stem or lug 13 effects the closing of the switch 14 with the consequent production of a tream of air by the impeller device 6 through the opening 5.

Figure 4A:
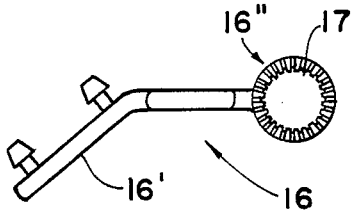
FIGS. 4A and 4B are views illustrating the tool for producing the bubbles.
Figure 4B:
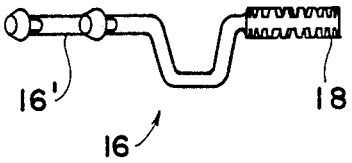
Figure 5:
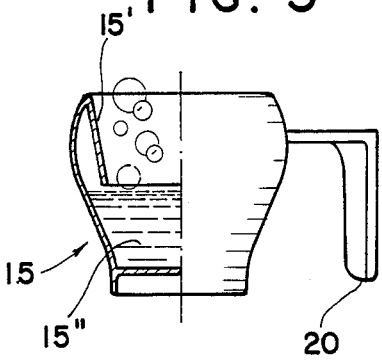
FIG. 5 is a side view illustrating the receptacle which contains the soapy solution.

Referring now to FIG. 5, the receptacle 15 is formed of inner upper and outer portions 15' and 15', respectively. The inner upper portion 15' has a downward directed concavity of a volumetric capacity approximately equal to that of the portion 15' so that even in the event that the receptacle 15 is tipped sideways or turned upside down, no loss of the liquid contained therein would take place since it would remain contained within the said concavity of the upper portion 15'. As shown in FIGS. 4A and 4B the tool 16 for the forming of the bubbles is formed of a handle portion 16' for attachment to the hand 21 of the arm 4 and a ring-shaped portion 16' for picking up and holding a film of bubble-making liquid for the forming of the bubbles. The ring-shaped portion 16' is provided on its inner periphery with a plurality of projections 17, whereas the outer periphery includes a plurality of indentations 18, both of which contribute to facilitating the formation of the film of bubble making liquid which is necessary for the forming of the bubbles.

The fastening of the receptacle 15 to the corresponding region of the trunk portion 3 can be effected in a variety of different ways. For instance, as shown in FIG. 3 protruding portion 19 may extend from the trunk portion 3 on which the handle 20 of the said receptacle 15 can be engaged. The handle 20 may be removable from the protruding portion 19 or may be permanently attached to protruding portion 19 during manufacture.

As will be easily understood by those skilled in this art, for the proper operation of the doll, it is necessary said receptacle 15 and said mouth opening 5 be arranged in the circumferential arc. More particularly, the bubble-forming tool 16, in order to ascend and descend as indicated by the arrow A in FIGS. 2 and 3 must be alternately brought opposite the mouth opening 5 and then introduced at the ring-shaped portion 16' into the inside of the receptacle 15 which contains the bubble making liquid, by the movable arm 4. The center of the circumferential arc is at the point of rotation of the arm 4 on the body and the radius of the arc is equal to the distance between said point and the ring-shaped portion 16 of the bubble-forming tool 16.

In this way, by the manual or mechanical actuation of the descent and ascent of the arm 4, the tool 16 becomes wetted with the bubble making liquid contained in the receptacle 15, with the consequent formation of a soapy film in the ring-shaped portion 16'. The ring-shaped portion 16' is then brought opposite the opening 5 of the head 2. A stream of air is then generated by the impeller device 6, and the desired bubble or bubbles are produced. As previously mentioned, the position of the stem or lug 13 of the arm 4 only acts on the switch 15 so as to cause the closing thereof to activate the impeller device 6, when said tool 16 has reached the vicinity of the opening 5.

Figure 9:
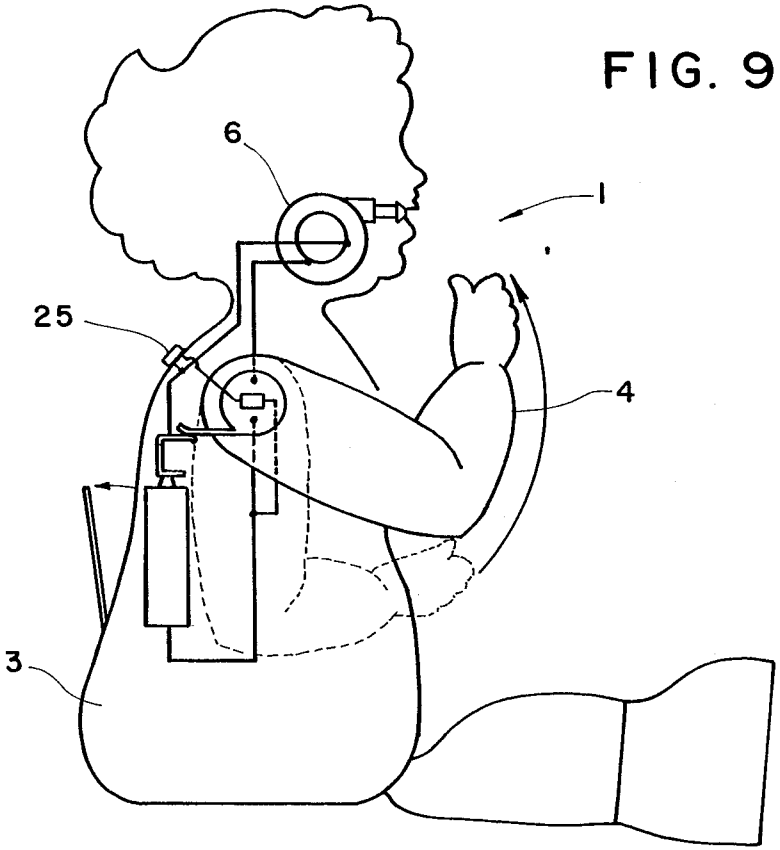
FIGS. 8 and 9 illustrate an alternative embodiment in which the arm movement is motor driven.
Figure 8:
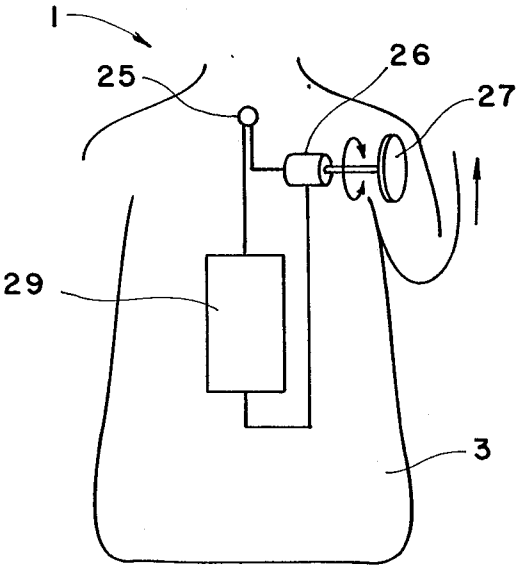

In the embodiment illustrated in FIG. 3, the arm 4 holding the bubble-forming tool 16 is manually moved from the receptacle 15 to the opening 5. This allows for the manufacture of a simple and low cost embodiment of the present invention. FIGS. 8 and 9 illustrates an alternate embodiment according to the present invention, whereby an electrically-driven mechanical device is introduced into the doll, for automatically moving the arm 4 to move the tool 16 from the receptacle 15 to the opening 5 and back again. This mechanical motion can be carried out by pushing a button 25 situated on the doll 1 above a battery compartment door 29 which closes a circuit thereby energizing a motor 26 which in turn activates a gear train 27 operatively connected between the motor 26 and the arm 4 portion, which causes the arm 4 and connected tool 16 to ascend and descend. The gear train 27 and motor 26 required for causing the ascending and descending motion of the arm 4 are well known to those in the art, and therefore, will not be further described herein. The rest of the structure of the doll is the same as is contained in the first embodiment. That is, when the arm 4 has ascended to a position such that the tool 16 is close to the opening 5, a circuit is closed by the contact of the stem or lug 13 and the blade switch 14, causing the air impeller device 6 to generate a stream of air through the opening 5 and the ring-shaped portion 16' of the tool 16, thereby producing bubbles.

A wide variety of embodiments are foreseeable from the basic embodiments that have been described above. The device can be noise actuated, such that a particular voice or noise command such as the clapping of hands can cause the ascending motion of the arm 3 and accompanying tool 16 to the opening 5 which would cause the air impeller 6 to generate air through the ring-shaped portion 16' of the tool 16, thereby producing bubbles.

As described above, the present invention has an added dimension in that it serves a dual purpose. Not only can the device be used for making bubbles, upon the removal of the receptacle 15 and tool 16, the device also serves as an ordinary doll for the user. The idolation of baby dolls by young children is of course well known. This also distinguishes the present invention from the above described single dimensional bubble blowing apparatuses.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A bubble producing doll, comprising:

(a) a doll body simulating a human figure with a trunk portion, a head connected to the trunk portion and having a mouth opening, a pair of arms having hand extremities with one arm pivotally mounted to the upper end of the trunk portion and a pair of legs connected to the lower end of the trunk portion;

(b) a receptacle connected to the front section of the trunk portion for storing bubble making liquid, wherein the receptacle has a first portion for containing said liquid when said receptacle is in an upright position and a second upper inner portion having a concavity within which said liquid remains contained when the receptacle is moved from the upright position.

(c) air producing means connected to the mouth opening formed in said head through which air is impelled;

(d) a battery-operated electrical circuit located inside the trunk portion for activating the air producing means;

(e) switching means connected to the electrical circuit for closing and opening the circuit and having a switching element located on the pivotally mounted arm; and (f) a bubble-making liquid, pick-up tool having first portion connected to the hand extremity of the pivotally mounted arm and a second portion for holding a film of the bubble making liquid, wherein the mouth opening in said head and the receptacle on the front section of the trunk portion are arranged along a circumferential arc centered at a point where said arm is pivotally mounted on the trunk, the arc having a radius equal to the distance between said point and the second portion of said tool, and wherein after the tool is placed in the receptacle and a film of liquid is formed thereon and when the pivotally mounted arm having the tool is raised to a position near the mouth opening of the doll head through the arc, the switching element on the arm closes the electrical circuit activating the air producing means to produce and simulate a human figure blowing bubbles produced from the film on the tool.

2. A doll according to claim 1, wherein the air producing means includes:

a cylindrical casing in which there is tangentially shaped an outlet nozzle for a generated stream of air as well as air aspiration grooves in a base of said casing, wherein said outlet nozzle is functionally connected with the mouth opening of said head portion;

a rotor having transverse vanes, and a motor having a battery for operating the motor and a live terminal connected to the rotor which is mounted within the cylindrical casing.

3. A doll according to claim 1, wherein the second portion of the tool is a ring-shaped portion having a plurality of projections on the inner periphery thereof and a plurality of indentations on the outer periphery thereof for facilitating the film of bubble making liquid.

4. The doll of claim 1, wherein the pivotally mounted arm is moved manually by the user of the doll.

5. The doll of claim 1, further comprising means for moving the pivotally mounted arm, the arm moving means having a batter power source, gear means operatively connected between the power source and the pivotally mounted arm; an electrical circuit for energizing the power source; and push button means for closing the electrical circuit and energizing the power source.

6. A bubble blowing doll, said doll comprising:

(a) a trunk;

(b) a receptacle for holding bubble making liquid, said receptacle having a first portion for containing said liquid when said receptacle is in an upright position and a second upper inner portion having a concavity within which said liquid remains contained in case said receptacle is moved from the upright position;

(c) an extremity pivotally mounted on said trunk;

(d) a bubble-making liquid, pick-up tool attached to the extremity;

(e) a head portion connected to said trunk, said head portion having an opening;

(f) an air impeller functionally connected to the opening in the head portion for impelling air through the opening;

(g) a battery-operated electrical circuit energizable to operate the air impeller; and (h) a switching element connected to the electrical circuit for closing and opening the circuit and having a switching member located on said pivotally mounted extremity, wherein, after the tool is placed in the receptacle and a film of liquid is formed thereon and when the extremity is then pivoted such that the tool is moved in an arc from in the receptacle to adjacent to the opening, the switching member on the extremity closes the electrical circuit and the air impeller is activated to cause bubbles to be produced from the film on the tool.

7. A bubble blowing doll according to claim 6, wherein said extremity is a pair of arms mounted pivotally on a single axis in said trunk causing the arms to move in unison.

8. A bubble blowing doll according to claim 6, wherein said extremity is moved manually by a user of said doll.

9. A bubble blowing doll according to claim 6 wherein said doll further comprises:

means for moving said pivotally mounted extremity, said means having gear means operatively connected between a power source and said pivotally mounted extremity; and push button means for closing a second circuit which energizes said power source.

* * * * *